US007500732B2

(12) United States Patent
James et al.

(10) Patent No.: US 7,500,732 B2
(45) Date of Patent: Mar. 10, 2009

(54) MAINTENANCE AND DOCKING STATION FOR A HAND-HELD PRINTER

(75) Inventors: Edmund Hulin James, Lexington, KY (US); Sarah Marie Springer, Lexington, KY (US); Randal Scott Williamson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 426 days.

(21) Appl. No.: 11/241,865

(22) Filed: Sep. 30, 2005

(65) Prior Publication Data

US 2007/0076045 A1 Apr. 5, 2007

(51) Int. Cl.
*B41J 2/165* (2006.01)

(52) U.S. Cl. ..... 347/29; 347/32; 347/33

(58) Field of Classification Search ..... 347/22–37, 347/108–109

See application file for complete search history.

(56) References Cited

U.S. PATENT DOCUMENTS

| | | | | |
|---|---|---|---|---|
| 4,675,700 | A | 6/1987 | Nagira et al. | |
| 5,024,541 | A | 6/1991 | Tsukada et al. | |
| 5,184,907 | A | 2/1993 | Hamada et al. | |
| 5,186,558 | A | 2/1993 | Sherman et al. | |
| 5,312,196 | A | 5/1994 | Hock et al. | |
| 5,578,813 | A | 11/1996 | Allen et al. | |
| 5,650,820 | A | 7/1997 | Sekine et al. | |
| 5,829,893 | A | 11/1998 | Kinoshita et al. | |
| 5,946,009 | A * | 8/1999 | Youn | 347/32 |
| 5,953,497 | A | 9/1999 | Kokubo et al. | |
| 5,984,455 | A | 11/1999 | Anderson | |
| 6,034,869 | A * | 3/2000 | Lin | 361/686 |
| 6,195,475 | B1 | 2/2001 | Beausoleil, Jr. et al. | |
| 6,347,897 | B2 | 2/2002 | Huggins et al. | |
| 6,357,939 | B1 | 3/2002 | Baron | |
| 6,394,598 | B1 * | 5/2002 | Kaiser | 347/109 |
| 6,398,340 | B1 * | 6/2002 | Lin | 347/33 |
| 6,609,844 | B1 | 8/2003 | Petteruti et al. | |
| 7,306,386 | B2 * | 12/2007 | Lyman et al. | 400/88 |
| 2001/0019349 | A1 | 9/2001 | Kawakami | |
| 2001/0022914 | A1 | 9/2001 | Iura et al. | |
| 2002/0171700 | A1 * | 11/2002 | Shinada et al. | 347/19 |
| 2004/0009024 | A1 | 1/2004 | Hardisty et al. | |
| 2005/0200685 | A1 * | 9/2005 | Silverbrook | 347/109 |
| 2006/0165460 | A1 | 7/2006 | Breton | |

FOREIGN PATENT DOCUMENTS

| | | | |
|---|---|---|---|
| SE | 103334 | | 10/1941 |
| SE | 522047 | | 1/2004 |
| SE | 527474 | C2 | 3/2006 |
| WO | WO 2004056576 | A1 | 7/2004 |

* cited by examiner

*Primary Examiner*—Juanita D Stephens
(74) *Attorney, Agent, or Firm*—Sutherland, Asbill & Brennan LLP

(57) ABSTRACT

A docking station includes a housing operable to receive and releasably secure a handheld printer, and a freeing mechanism, where the freeing mechanism is operable to release the handheld printer from the housing. The docking station also includes a print head cap operable to receive a print head of the handheld printer when the handheld printer is secured in the housing, and a print head wiper, where the print head wiper is operable to wipe the print head of the handheld printer during the release of the handheld printer from the housing.

17 Claims, 11 Drawing Sheets

MAINTENANCE AND DOCKING STATION FOR A HAND-HELD PRINTER

FIELD OF THE INVENTION

The present invention relates generally to handheld printers, and more particularly, to docking stations for housing and maintaining handheld printers.

BACKGROUND OF THE INVENTION

Portable computer printers are well known in the prior art and include dot-matrix printers, piezo-electric ink jet printers, laser printers and thermal ink jet printers. When using handheld printers the printing surface is not fed through the printer, but rather the handheld printer is placed on a printing surface. On many handheld printers, printing is accomplished by way of a print head being applied to a desired printing surface. The handheld printer is generally aligned with the printing surface in a fashion so that the image may be linearly printed across the surface. The print head is then initiated to begin printing the desired image onto the printing surface.

It will be appreciated that in order for the handheld printer to optimally perform, the print head must be maintained in such a way that it will be clean prior to each use. Furthermore, it will be appreciated that the print head needs to be capped and protected between uses of the handheld printer. However, conventional methods for manually capping and cleaning the print head do not ensure that a user will properly maintain the print head. A user may forget to cap the print head when the printer is not in use. A user may also fail to wipe the print head clean before using the handheld printer. Even if the user does clean the print head, it may be done in an unsatisfactory manner resulting in damage to or misalignment of the print head.

Therefore, what is needed are methods and apparatuses for automatically capping the print head when a handheld printer is not in use and forcing the user to uncap and safely wipe the print head before using the handheld printer.

BRIEF SUMMARY OF THE INVENTION

According to one embodiment of the invention, there is disclosed a docking station. The docking station includes a housing operable to receive and releasably secure a handheld printer, a freeing mechanism, where the freeing mechanism is operable to release the handheld printer from the housing, and a print head cap operable to receive a print head of the handheld printer when the handheld printer is secured in the housing.

According to one aspect of the invention, the docking station may include a print head wiper, where the print head wiper is operable to wipe the print head of the handheld printer during the release of the handheld printer from the housing. According to another aspect of the invention, the print head cap is operable to enclose the print head of the handheld printer when the handheld printer is secured in the housing. The docking station may also include at least one control rib operable to position the print head of the handheld printer when the handheld printer is secured in the housing. According to yet another aspect of the invention, the print head cap may include at least one rubber seal. The freeing mechanism of the docking station may also include a rotatable lever or wheel, and may be operable to move the at least one docking latch to release the handheld printer from the housing when the freeing mechanism is operated. Additionally, the docking station may include at least one docking latch operable to releasably secure a handheld printer to the housing.

According to another embodiment of the invention, there is disclosed a method for releasably capping a print head. The method includes receiving, in a housing, a handheld printer, and capping a print head of the handheld printer upon its insertion into the housing, where capping is performed by a print head cap operable to receive the print head of the handheld printer. The method also includes releasing the print head from the print head cap when the handheld printer is released from the housing.

According to one aspect of the invention, the method also includes wiping the print head during the release of the handheld printer from the housing using a print head wiper. According to another aspect of the invention, capping the print head includes enclosing the print head of the handheld printer when the handheld printer is secured in the housing. The method may also include positioning the print head of the handheld printer in the housing using at least one control rib operable to position the print head of the handheld printer in the housing. The print head cap may also include at least one rubber seal. According to yet another aspect of the invention, releasing the print head includes releasing the print head using a rotatable lever or wheel. Additionally, the method may include releasing the handheld printer from the housing using a freeing mechanism. The method may also include moving at least one docking latch to release the handheld printer from the housing using the freeing mechanism.

According to yet another embodiment of the invention, there is disclosed a method of cleaning a handheld printer. The method includes receiving a hand held printer in a docking station, and wiping the print head of the hand held printer during release of the hand held printer from the docking station using a print head wiper within the docking station.

According to one aspect of the invention, wiping the print head includes wiping the print head upon the movement of a freeing mechanism of the docking station. According to another aspect of the invention, the movement of the freeing mechanism of the docking station is based is effected by a user.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
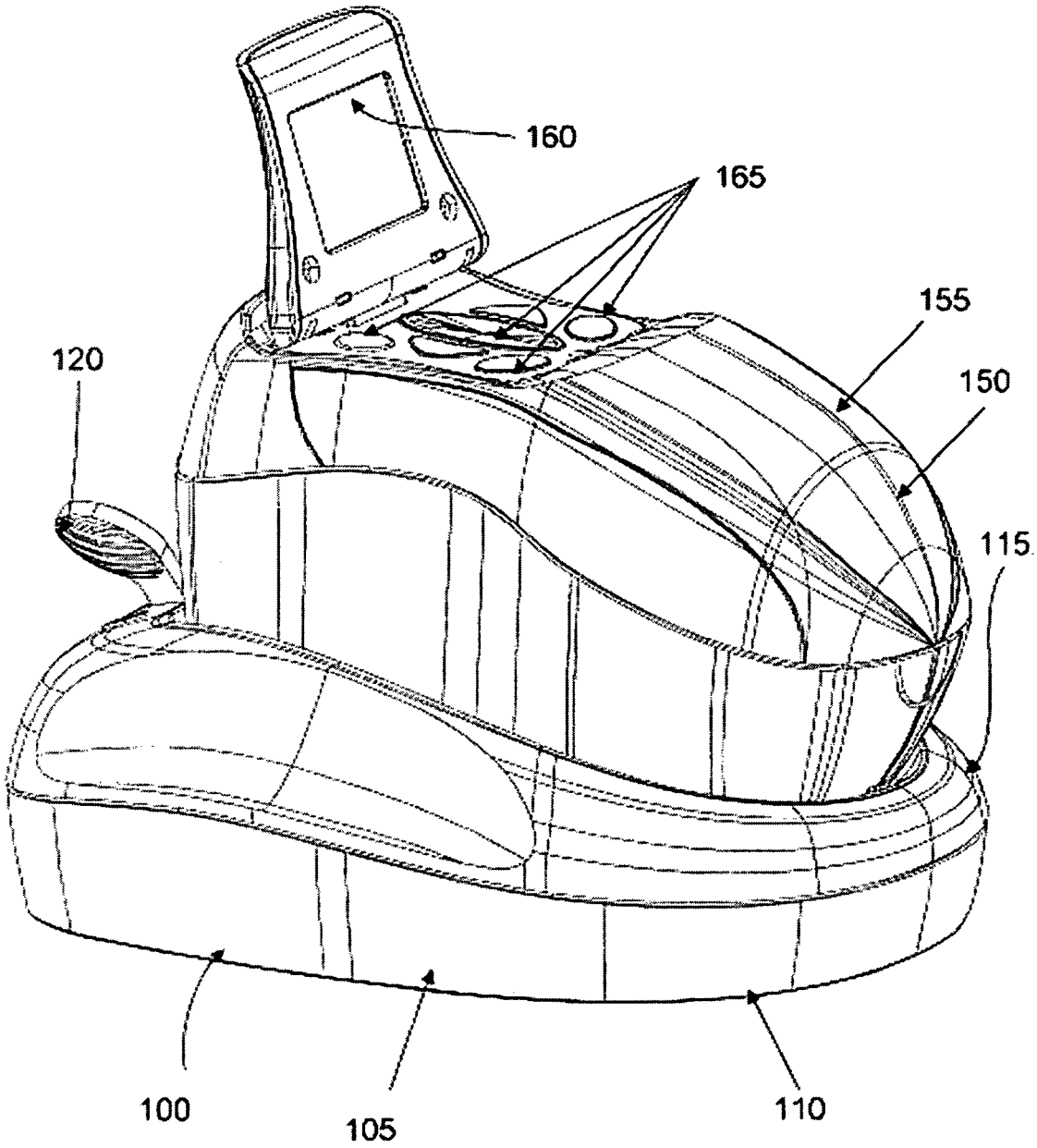
FIG. 1 shows a perspective view of a handheld printer resting in a docking station, according to an illustrative embodiment of the present invention.

FIG. 1 shows a perspective view of a handheld printer 150 resting in a docking station 100, according to an illustrative embodiment of the present invention. The handheld printer 150 generally includes a housing 155 for enclosing printer components, a display screen 160, such as an LCD screen, one or more buttons 165 for controlling the operation of the handheld printer 150, and a print head (see FIG. 6) for transferring a desired image onto a printing surface. The handheld printer docking station 100 generally includes a housing 105 for enclosing docking station component and a freeing mechanism 120 for releasing the handheld printer 150 from the docking station 100.

According to one aspect of the present invention, the docking station housing 105 is comprised of a bottom cover 110 and a top cover 115, which is designed to attach to the bottom cover 110 by way of a number of interlocking members 205. These interlocking members 205 may be plastic tabs extending downwardly from the bottom surface of the top cover 115 that fit into corresponding upwardly opening receiving members 405 on the bottom cover 110. It will be appreciated by those skilled in the art that the top cover 115 and the bottom cover 110 can be connected by any number of tabs, bolts, screws, or snaps. Furthermore, it will be understood that the top cover 115 can also be releasably attached to the bottom cover 110 or that the docking station housing 155 can include any number of pieces.

According to an embodiment of the present invention, the freeing mechanism 120 is a lever which a user may pull to release the handheld printer 150 from the docking station 100. According to a second embodiment of the present invention, the freeing mechanism 120 is a thumb wheel design. When the handheld printer 150 is resting in the docking station 100, the print head is maintained in an original capped position, as is shown and described with respect to FIG. 6. As discussed below, activating the freeing mechanism 120 will initiate uncapping of the print head followed by a wiping of the printing surface of the print head. The freeing mechanism 120 is spring returned to the original capped position when it is released by a user. It will be understood by those of skill in the art that the freeing mechanism 120 could be a lever, a thumb wheel, or any other mechanical apparatus capable of being spring-returned to an original position. It will further be understood that it is possible for the freeing mechanism to be activated electronically, such as by having a user press an electronic button, rather than by a manual user interaction with the freeing mechanism.

Figure 2:
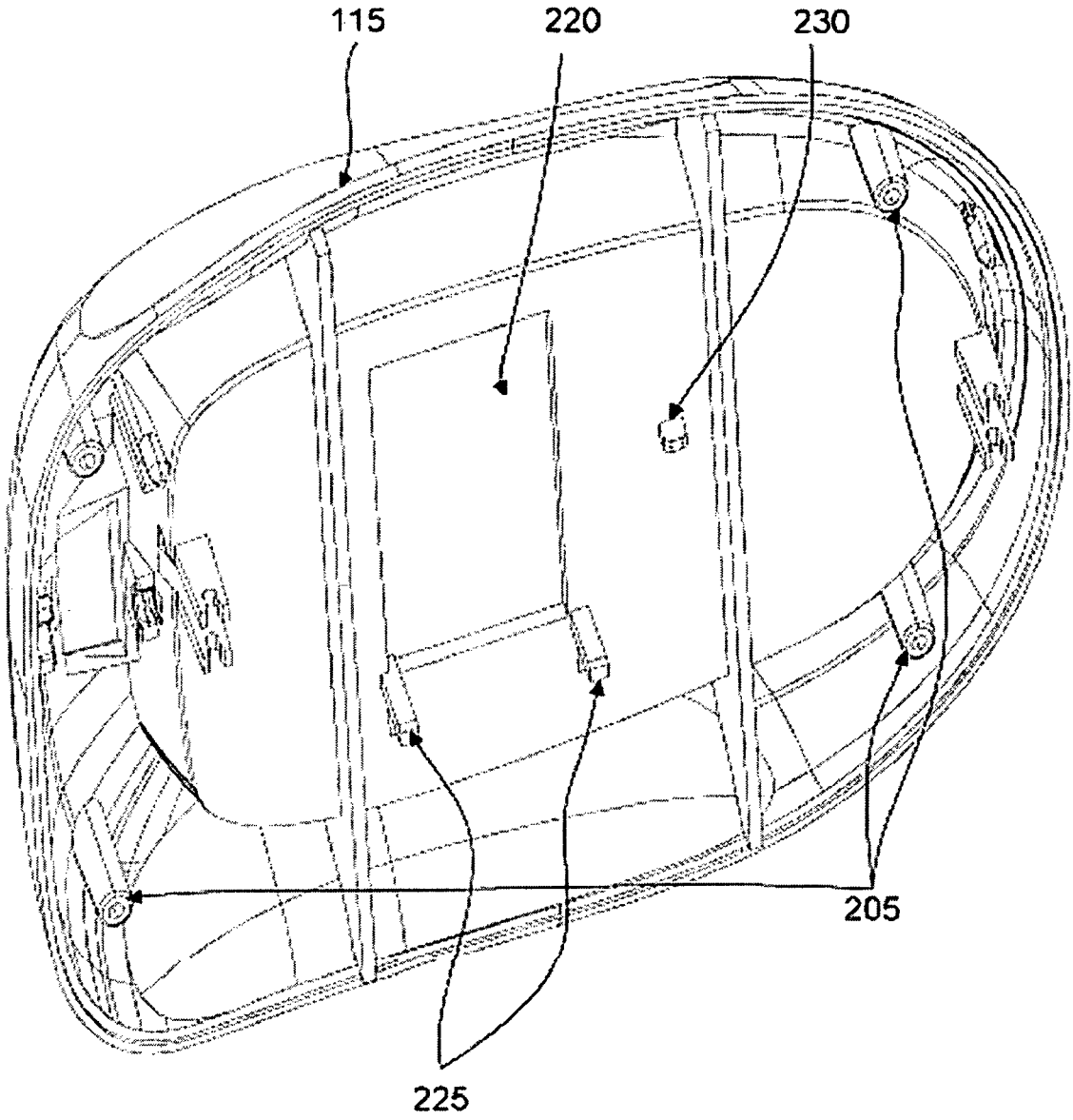
FIG. 2 shows a perspective view of the underside of the top cover, according to an illustrative embodiment of the present invention.
Figure 4A:
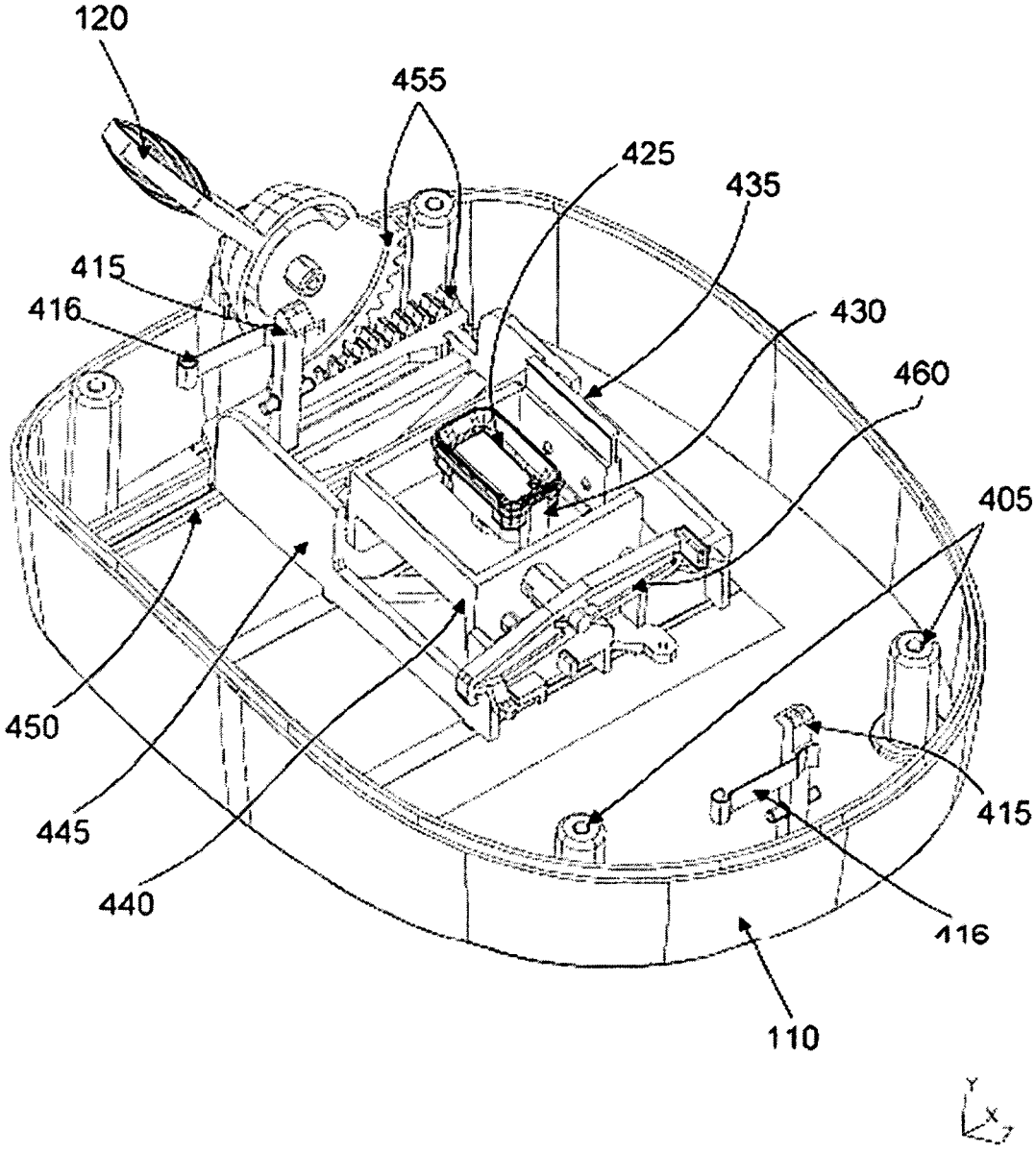
FIG. 4A shows a perspective view of a handheld printer docking station with the top cover removed, according to one illustrative embodiment of the present invention.

FIG. 2 shows a perspective view of the underside of the top cover 115, as illustrated by one embodiment of the present invention. The top cover 115 of the docking station housing preferably includes an opening 220 into which the print head of a handheld printer 150 fits so that it can be maintained by the internal components of the docking station 100. The interlocking members 205, used for connecting the top cover 115 to the bottom cover 110 are also shown. According to one embodiment of the present invention, two cap location control ribs 225 extend downwardly from the underside of the top cover 115 ensure that when the print head is returned to the docking station, it is placed in an original capped position. When the freeing mechanism 120 is returned to the original capped position, the cap location control ribs 225 ensure that the maintenance sled housing, as shown in FIG. 4A, is stopped in a position such that the print head will be returned to a capped position when a handheld printer is placed in the docking station. A sled delatch block 230 extending downwardly from the bottom surface of the top cover is also shown in FIG. 2. As discussed in detail below, the sled delatch block 230 allows the maintenance sled to be delatched so that it can drop to a down most position in the docking station housing. This allows the docking station latches (see FIG. 5) to be opened so a handheld printer can be removed from the docking station by a user.

Figure 3A:
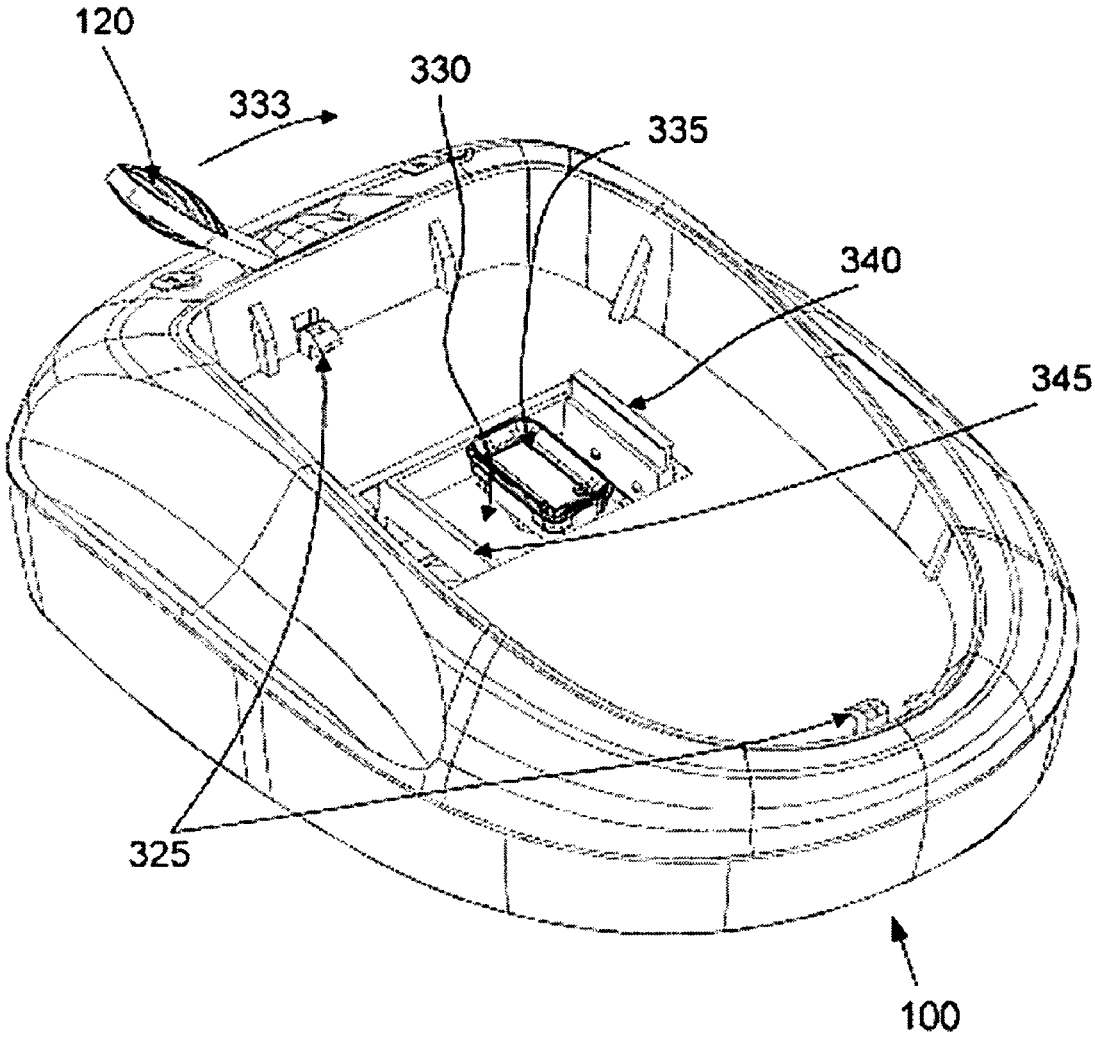
FIG. 3A shows a perspective view of a handheld printer docking station, according to one illustrative embodiment of the present invention.

FIG. 3A shows a perspective view of a handheld printer docking station 100, according to an illustrative embodiment of the present invention. The freeing mechanism 120 is shown as a lever design in this illustrative embodiment though it will be appreciated that alternate designs, such as a wheel, may also be used. FIG. 3A shows two docking latches 325 for holding the handheld printer in place while on the docking station. A handheld printer is released from the docking station when a user pulls the lever of the freeing mechanism 120 laterally 333 from a first, locked position to a second, unlocked position. When this occurs, the docking latches 325 are opened. According to one aspect of the invention, the unlocked position is approximately 87 total degrees of rotation from the locked position. While holding the lever in its unlocked position, the user can remove the handheld printer from the docking station 100. When the user releases the lever of the freeing mechanism, it is returned to its original locked position via a system return spring, as shown and described with respect to FIG. 5. FIG. 3A also shows some of the maintenance components of the docking station, which are visible through an opening 330 in the top cover 115 and whose operations are described in detail below. These components include the print head cap 335 and the print head wiper 340, both of which are affixed to the maintenance sled 345.

Figure 3B:
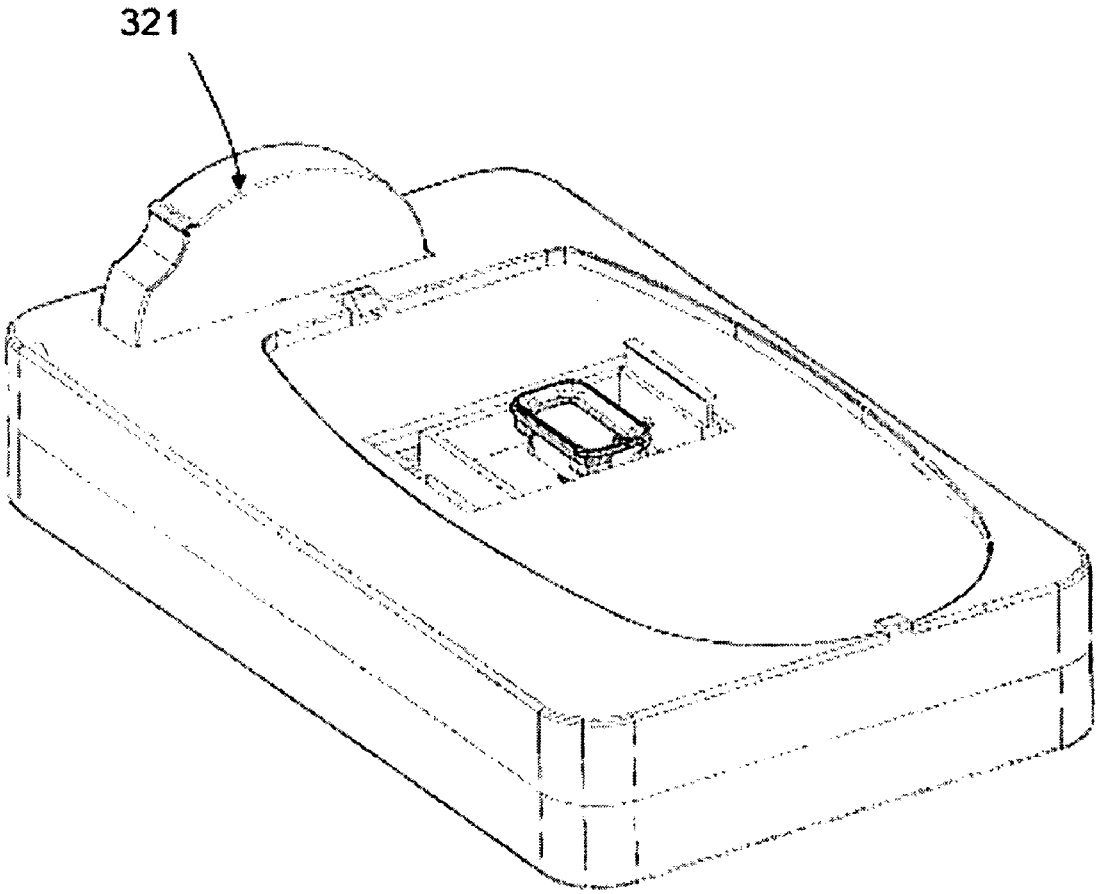
FIG. 3B shows a perspective view of a handheld printer docking station, according to a second illustrative embodiment of the present invention.

FIG. 3B shows a perspective view of a handheld printer docking station, according to another illustrative embodiment of the present invention. The freeing mechanism 321 is shown as a thumb wheel in this embodiment of the invention. It will be appreciated that the illustrative embodiment of the present invention shown in FIG. 3B functions in a similar matter to the illustrative embodiment depicted in FIG. 3A. Furthermore, it will be understood by those skilled in the art that the present invention can be implemented in additional ways, including that depicted in FIG. 3B.

Figure 4B:
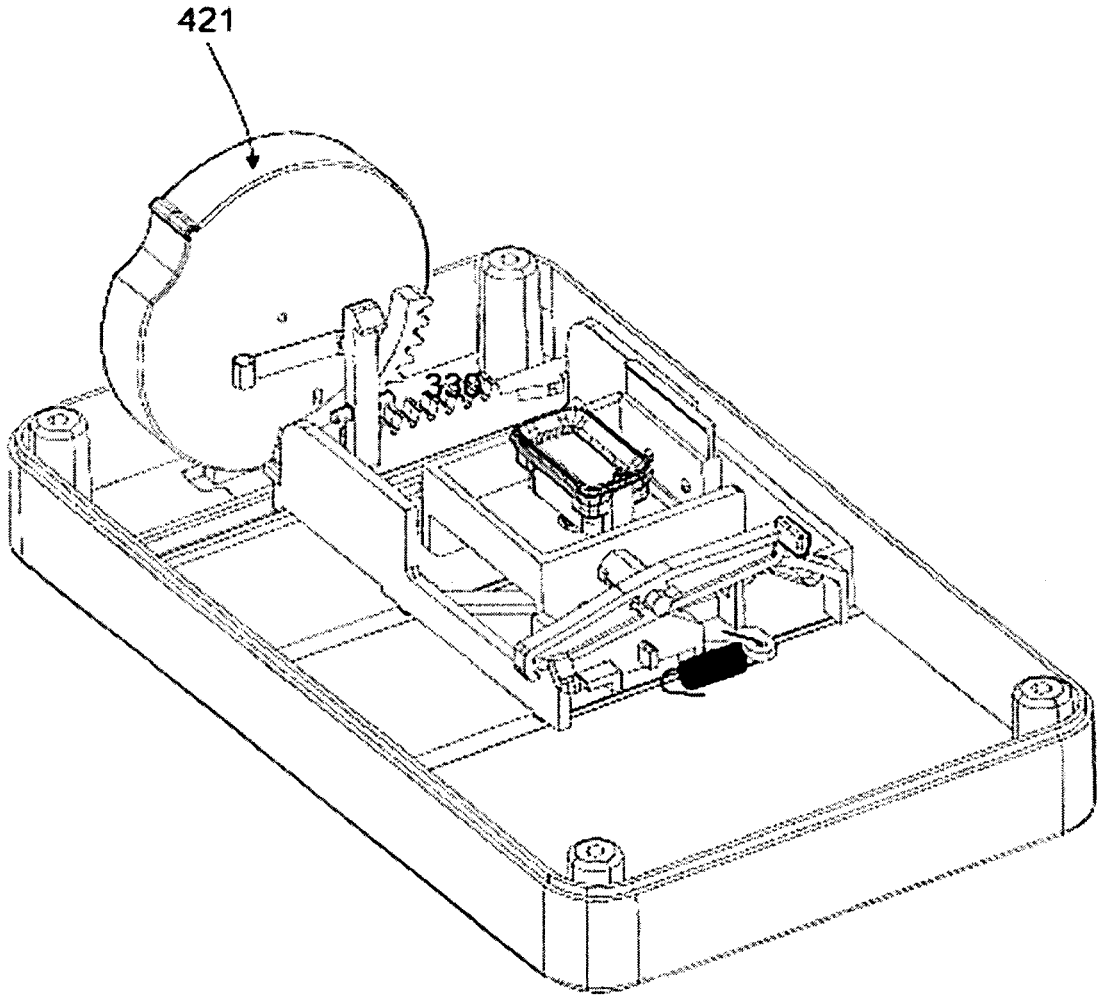
FIG. 4B shows a perspective view of a handheld printer docking station with the top cover removed, according to a second illustrative embodiment of the present invention.

FIG. 4A shows a perspective view of a handheld printer docking station 100 with the top cover removed, according to illustrative embodiment of the present invention utilizing a lever as a freeing mechanism 120. Similarly, FIG. 4B shows a perspective view of a handheld printer docking station with the top cover removed, according to another illustrative embodiment of the present invention which utilizes a thumb wheel as a freeing mechanism, as was shown in FIG. 3B. The functionality of both embodiments of the present invention are similar; therefore, the description of only one embodiment of the present invention will be detailed herein with respect to FIG. 4A. However, it is to be understood by those skilled in the art that the present invention can be implemented in many other ways, and that the embodiments shown in FIGS. 4A and 4B are illustrative examples.

As shown in FIG. 4A, the receiving members 405 that connect the top cover and the bottom cover extend upwardly from the bottom cover 110. The receiving members 405 receive the interlocking members 205 that extend downwardly from the inside of the top cover 115. The internal maintenance components of the docking station are retained within the bottom cover 110. By way of a system return spring, shown in FIG. 5, the freeing mechanism 120 will automatically return the docking station to an original capped (or locked) position after a user has removed a handheld printer and released the freeing mechanism 120. When a handheld printer is placed onto the docking station, the print head will automatically be capped by the docking station. The print head of a handheld printer will fit into a print head cap 425 which rests in a cap holder 430. As described earlier, the cap location control ribs 225 that extend downwardly from the underside of the top cover 115 ensure that when the handheld printer is placed onto the docking station the print head cap 425 is in the correct position. Specifically, the cap location control ribs ensure that the maintenance sled housing 450 is stopped so that the print head cap 425 is positioned correctly when the docking station returns to the original capped position. The capping and protection of the print head protects the print head when it is not in use.

According to one aspect of the present invention, when a user wishes to remove a handheld printer from the printer docking station, he/she must do so by rotating the freeing mechanism 120. The full range of the freeing mechanism 120 between the original capped position and the unlocked position may be approximately 87 degrees of rotation, though it will be appreciated that any amount of rotation may suffice. For instance, approximately 50-120 degrees of rotation may also be used. The freeing mechanism 120 is coupled to the maintenance sled housing 445 by way of a rack-and-pinion gear train 455. As the freeing mechanism 120 is rotated, the maintenance sled housing 445 translates in a linear fashion towards one side of the docking station bottom cover 110 along the maintenance sled housing track 450.

According to the depicted embodiment of the present invention, the freeing mechanism 120 will be rotated in a clockwise manner and the maintenance sled housing 445 will translate in a direction along the negative x-axis of the docking station bottom cover 110. However, it is to be understood by those skilled in the art that the freeing mechanism can be designed to rotate in a counter-clockwise manner and that the maintenance sled housing can be designed to move in any linear direction along the bottom cover. In an embodiment of the present invention, the maintenance sled housing 445 may have a total translation of approximately 33.25 mm along the maintenance sled housing track 450, which corresponds to the approximate 87 degrees of total rotation of the freeing mechanism 120. It will be easily recognizable by those of skill in the art that the freeing mechanism could be designed to have more or less than 87 degrees of total rotation and that the maintenance sled housing could be designed to have more or less than 33.25 mm of total translation along the sled housing track. According to yet another aspect of the present invention, the maintenance sled 440 may travel in a cam profile, as will be understood by those skilled in the art. This cam profile may be built into the maintenance sled housing 445 and control the vertical movement of the maintenance sled 440, print head cap 425, and print head wiper 435 in relation to the maintenance sled housing 445.

According to a further aspect of the present invention, as the user rotates the freeing mechanism 420 approximately 22 degrees, the maintenance sled housing 445 translates approximately 8.25 mm along the maintenance sled housing track 450. The maintenance sled 440, print head cap 425, and print head wiper 435 are allowed to lower in the cam profile of the maintenance sled housing 445 until the sled latch 460 catches the maintenance sled housing 445. The docking station is now in a wipe position. When the maintenance sled 440 catches in a wipe position, it will be translated along the maintenance sled housing track 450 along with the maintenance sled housing 445. At this point, the print head of a handheld printer resting in the docking station is uncapped. Further rotation of the freeing mechanism 120 by approximately 55 degrees causes the maintenance sled housing 445, with the maintenance sled 440, print head cap 425, and print head wiper 435 attached to the maintenance sled housing 445, to be translated approximately 21 mm along the maintenance sled housing track 450. This translation causes the print head wiper 435 to complete a wipe of the print head of a handheld printer resting in the docking station. The uncapping and wiping of the print head occur without moving the handheld printer. This will ensure that the wiping is done correctly and safely each time before the handheld printer is used.

According to an aspect of the invention, after the print head wiper 435 has cleared the print head and another approximate 10 degrees of rotation are imparted to the freeing mechanism 120, the sled latch 460 will contact the sled delatch block (see FIG. 2) that extends downwardly from the under side of the docking station top cover. Upon contact with the sled delatch block, the sled latch 460 will be released from the maintenance sled housing 445 and the maintenance sled 440, print head cap 425, and print head wiper 435 will be allowed to drop to a down most position in the maintenance sled housing 445. The total movement of the maintenance sled 440 within the maintenance sled housing 445 will be approximately 4 mm.

According to another aspect of the present invention, as the maintenance sled 440 is delatching and dropping to its down most position, the docking station latches 415 are also translated along a cam (not illustrated) built into the maintenance sled housing 445. This cam compresses a pair of leaf springs hereinafter referred to as the docking springs 416, which rotates the docking station latches 415 to an open position. It will be understood by those skilled in the art that any number of docking station latches could be used in the present invention. When the docking station latches 415 are rotated into an open position, a user can remove a handheld printer from the docking station. The user must hold the freeing mechanism 120 in its unlocked position while removing the handheld printer. Otherwise, the system return spring 521 (FIG. 5) will cause the docking station to return to its original capped position. When the user lets go of the freeing mechanism 120, the docking station will return to its original capped position and be ready for a handheld printer to be placed onto the docking station.

It will be appreciated that the present invention could also be implemented as a one handed operation by adding additional features. For example, a detent or other catch could be added to maintain the freeing mechanism and the docking station in its unlocked position. A plunger or other release mechanism could then be added to sense the placement of a handheld printer into the docking station and release the detent. This may effectively return the docking station to its original capped position without moving the handheld printer.

Figure 5:
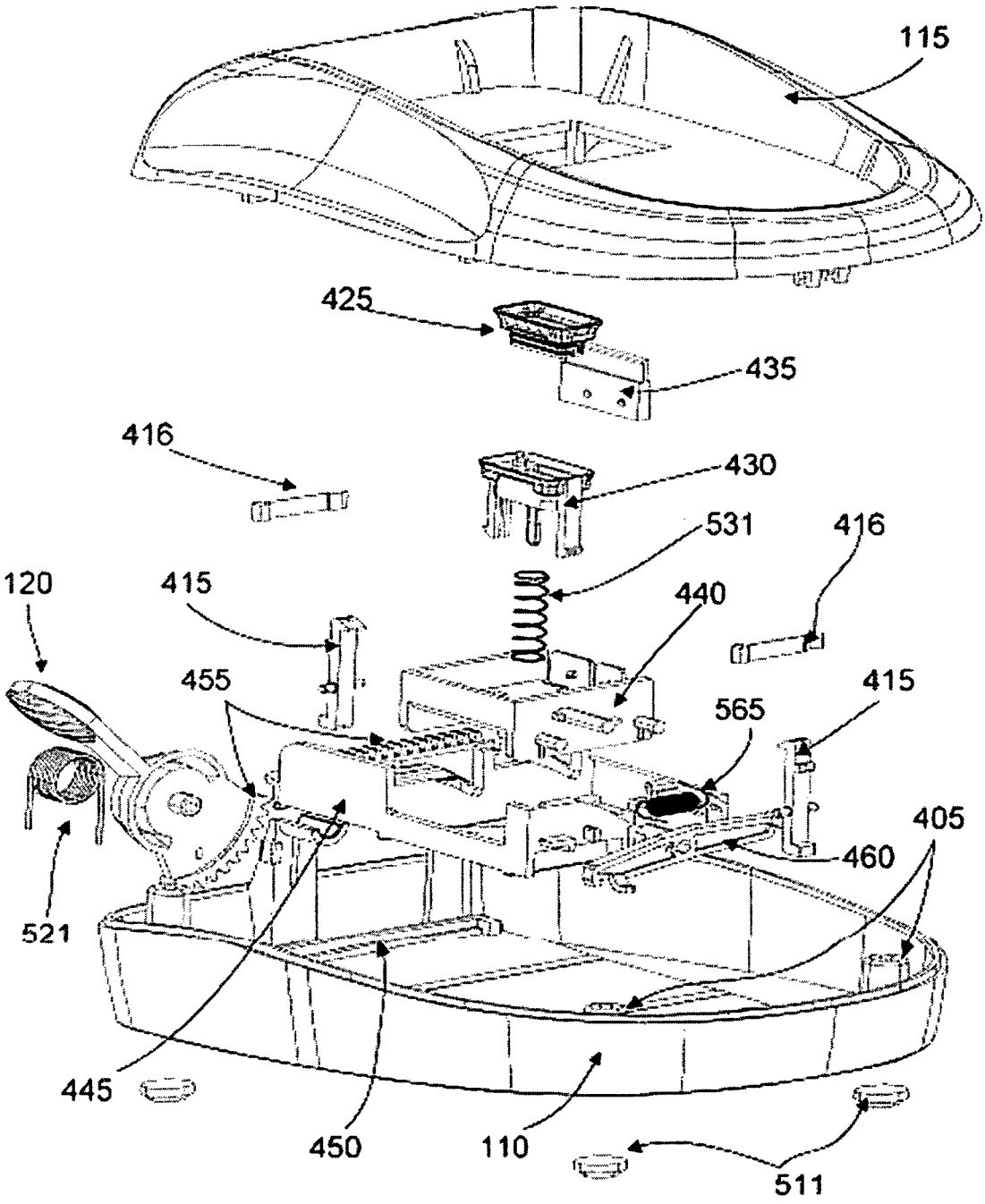
FIG. 5 shows a perspective view of the internal components of a handheld printer docking station, according to an illustrative embodiment of the present invention.

FIG. 5 shows a perspective view of many of the internal components of a handheld printer docking station, according to an illustrative embodiment of the present invention. The functionality of these components has already been described in detail above, and the figure is only provided for convenience as it illustrates how many of the components of the docking station fit together according to an illustrative embodiment of the present invention. The top cover 115 is connected to the bottom cover 110 by way of interlocking members (not shown) extending downwardly from the top cover 115 which connect with receiving members 405 extending upwardly from the bottom cover 110. Additionally, feet 511 can be attached to the bottom cover of the docking station to prevent the docking station from sliding on or damaging surfaces on which it will rest.

The maintenance sled housing 445 sits within the maintenance sled housing track 450 and is translated linearly along the maintenance sled housing track upon rotation of the freeing mechanism 120 by way of a rack-and-pinion gear train 455. The maintenance sled 440 travels in a cam profile built into the maintenance sled housing 445. The printer head cap 425 sits within a cap holder 430 which is spring mounted by way of a cap holder spring 531 to the top surface of the maintenance sled 440. The print head wiper 435 is also connected so as to extend upwardly from the maintenance sled 440. As discussed in detail above, as the freeing mechanism 120 is rotated, the maintenance sled housing 445 is translated along the maintenance sled housing track 450. The maintenance sled 440 will lower in the maintenance sled housing 445 until the sled latch 460 catches in a wipe position. The sled latch 460 is spring mounted to the maintenance sled 440 and the maintenance sled housing 445 with a sled latch spring 565. Further rotation of the freeing mechanism 120 will perform a wipe of the print head and will lead to depression of the docking latch springs 416. The docking latches 415 will be forced into an open position allowing the user to remove a handheld printer from the docking station. When the user releases the freeing mechanism 120, the docking station will return to an original capped position by way of a system return spring 521.

Figure 6:
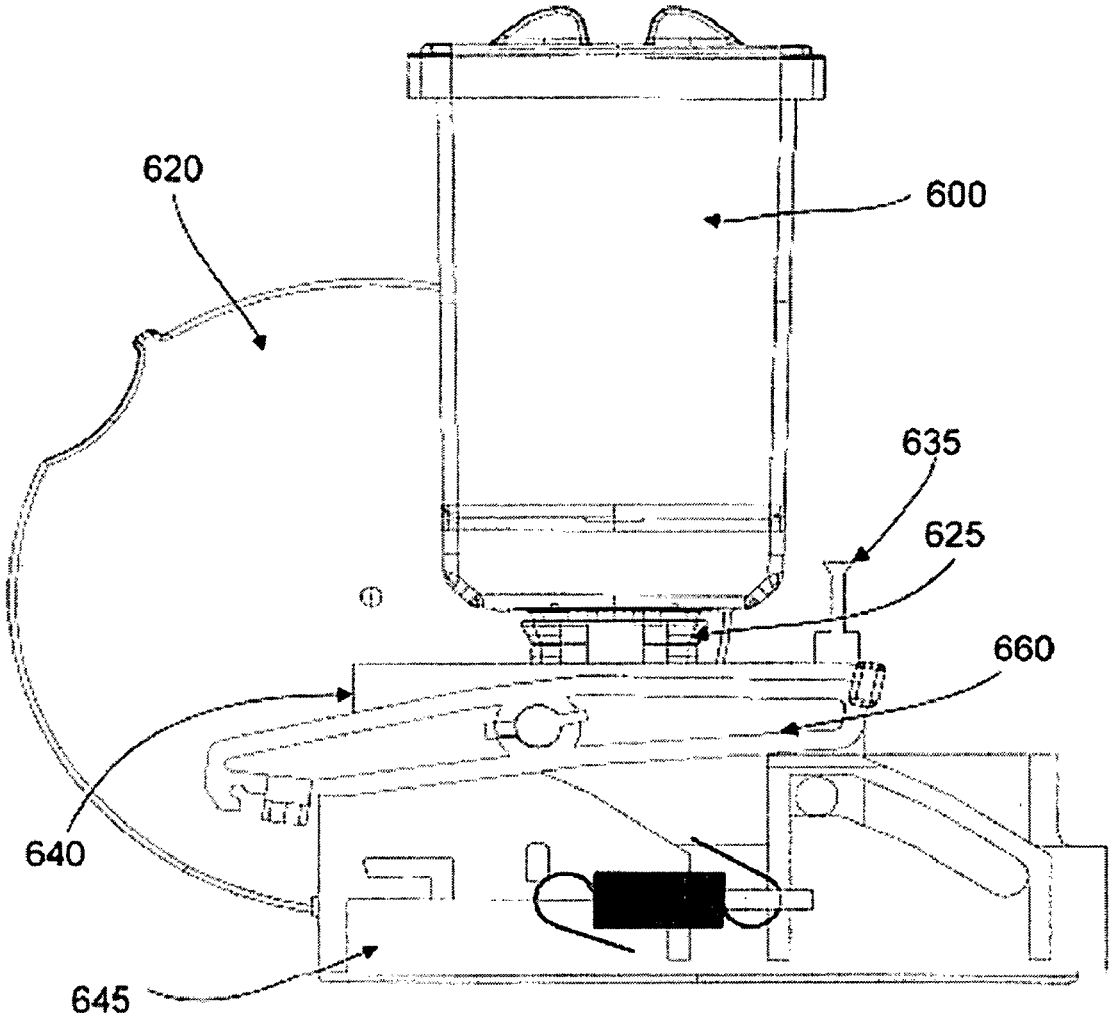
FIG. 6 shows the maintenance of a print head in a capped position, according to an illustrative embodiment of the present invention.

FIGS. 6-9 illustrate the proper maintenance of a print head in a docking station of the present invention, according to an embodiment of the present invention. FIG. 6 shows the maintenance of a print head 600 in an original capped position. The print head 600 rests within the print head cap 625. The original capped position is controlled by two cap location control ribs (not shown) extending downwardly from the underside of the top cover of the docking station. The freeing mechanism 620, print head wiper 635, maintenance sled 640, maintenance sled housing 645, and sled latch 660 are all shown in their original capped position.

Figure 7:
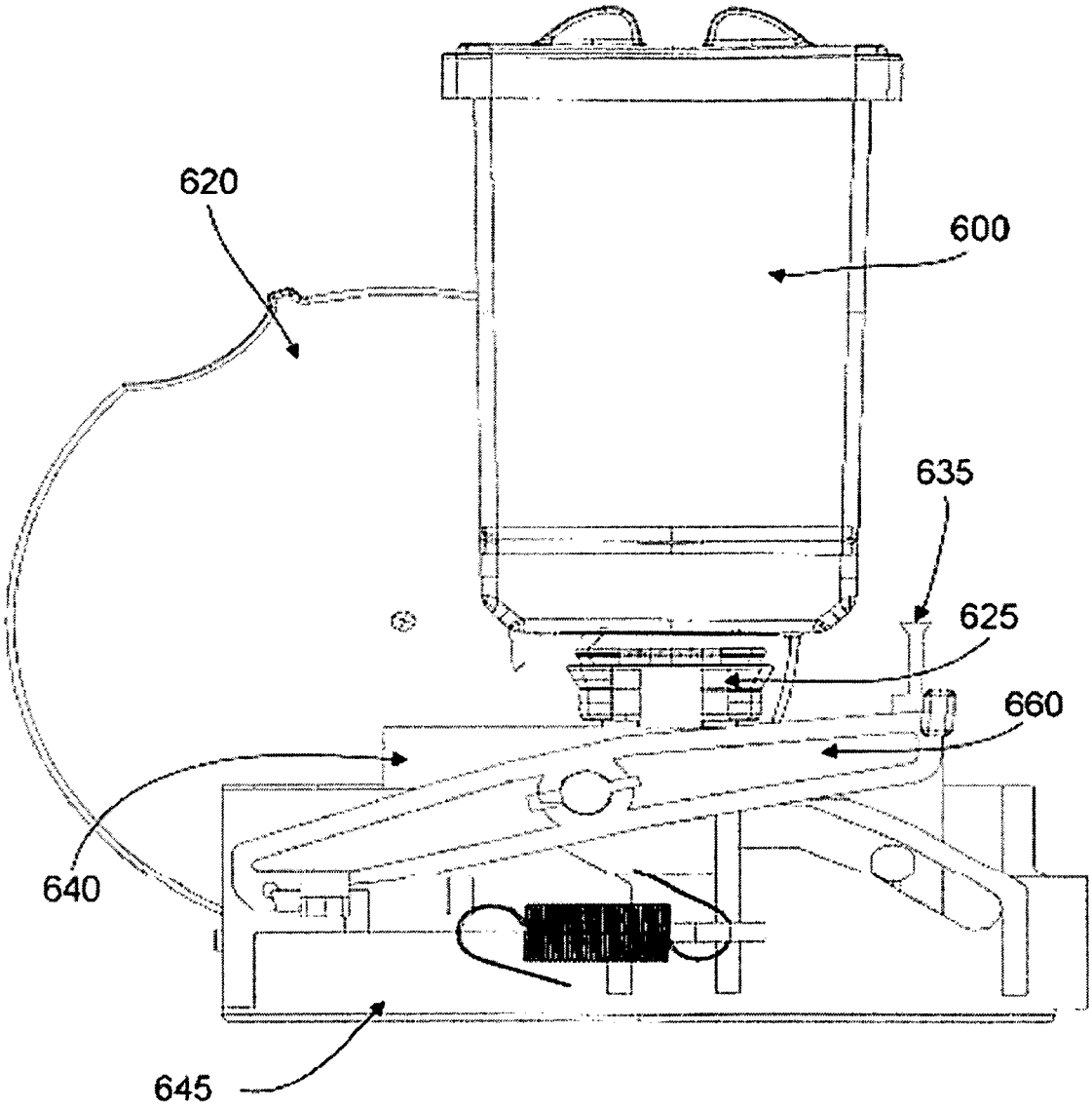
FIG. 7 shows the maintenance of a print head in an uncapped position ready for the wipe movement, according to an illustrative embodiment of the present invention.

FIG. 7 illustrates the proper maintenance of the print head 600 of FIG. 6 in the docking station in an uncapped wipe position, according to one embodiment of the present invention. Rotation of the freeing mechanism 620 has caused the maintenance sled housing 645 to translate to the left by way of a rack-and-pinion gear train (not shown). The maintenance sled 640, print head cap 625, and print head wiper 635 have been allowed to lower in their cam profile within the maintenance sled housing 645. The sled latch 660 has caught the maintenance sled housing 645, and the maintenance sled 640 and print head wiper 635 are now in a wipe position.

Figure 8:
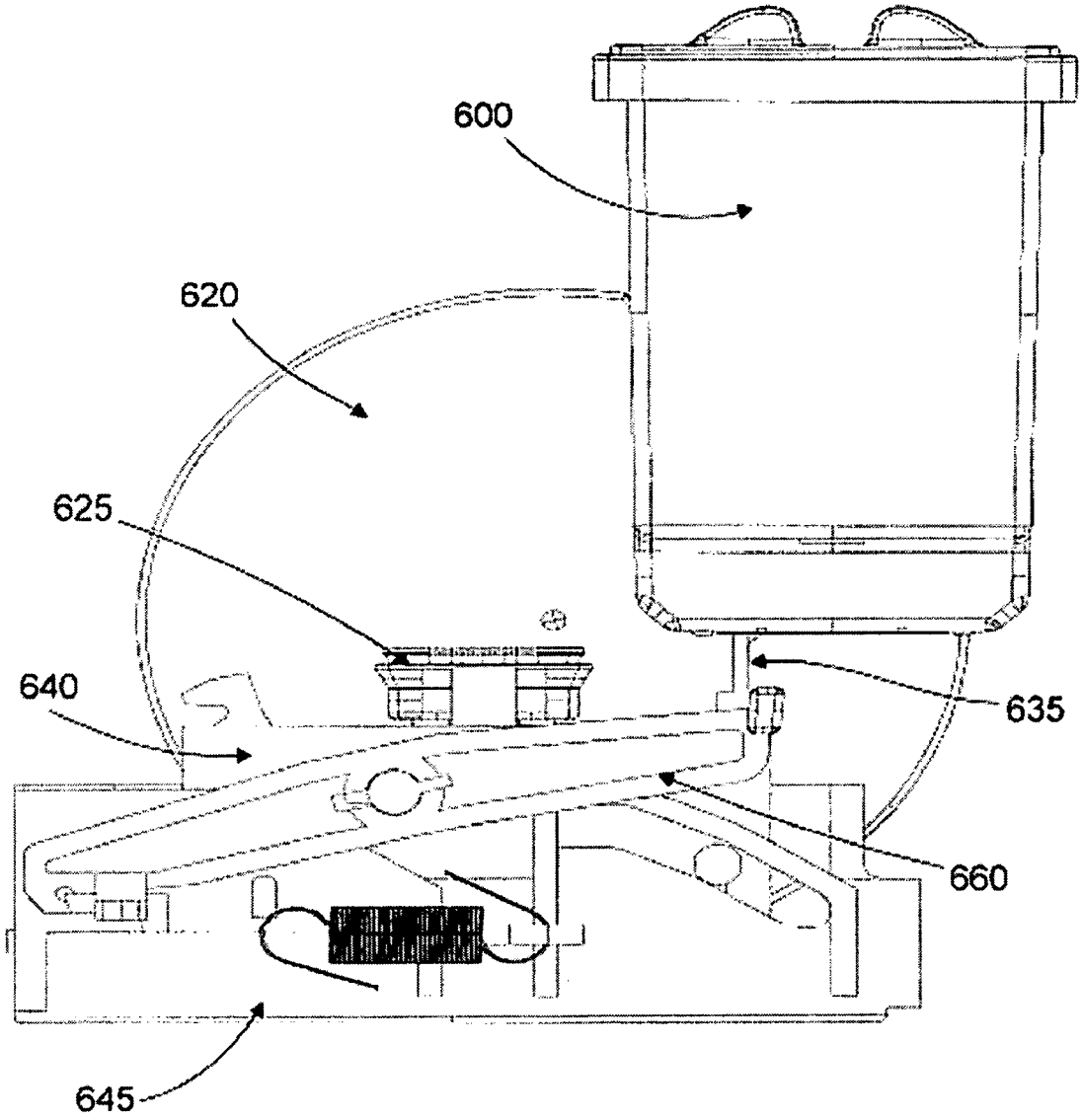
FIG. 8 shows the maintenance of a print head after a completed wipe movement, according to an illustrative embodiment of the present invention.

Next, FIG. 8 illustrates the proper maintenance of the print head 600 in the docking station after a completed wipe of the print head, according to one embodiment of the present invention. Further rotation of the freeing mechanism 620 has caused the maintenance sled housing 645, with the maintenance sled 640, print head cap 625, and print head wiper 635 attached via the sled latch 660, to translate further to the left. The print head wiper 635 has completed a wipe of the nozzles of the print head 600. According to the shown embodiment of the present invention, the sled latch 660 will now contact the sled delatch block (not shown), which extends downwardly from the inside of the top cover of the docking station. This will cause the sled latch 660 to delatch from the maintenance sled housing 645 and allow the maintenance sled 640 to drop to its down most position in its cam profile.

Figure 9:
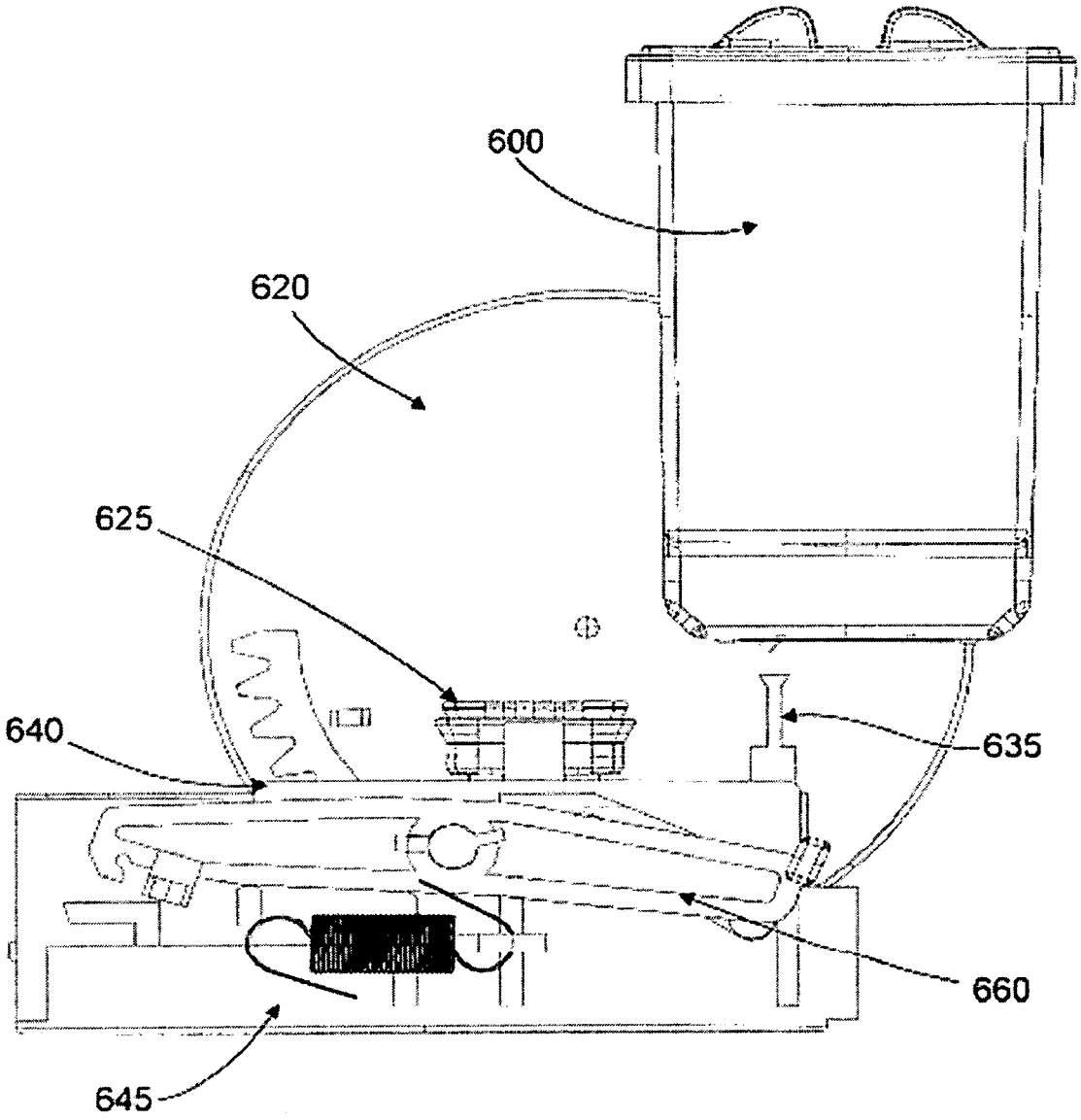
FIG. 9 shows the maintenance of a print head in an unlatched position, according to an illustrative embodiment of the present invention.

FIG. 9 illustrates the proper maintenance of a print head 600 in the docking station in an unlocked position, according to one embodiment of the present invention. The maintenance sled 640 has delatched from the maintenance sled housing 645 due to the sled latch 660 making contact with the sled delatch block (not shown). The maintenance sled 640, print head cap 625, and print head wiper 635 have dropped to a down most position in the cam profile of the maintenance sled housing 645. Additionally, the docking latches (not shown) have unlached due to a cam located on the maintenance sled housing 645 compressing the docking latch springs (not shown). While holding the freeing mechanism 620 in its unlocked position, a user can now remove a handheld printer from the docking station. A user will not be allowed to remove a handheld printer from the docking station until after the print head wipe has been completed. Further, the capping, uncapping, and wiping of the print head all occur without moving the handheld printer. After the handheld printer has been removed and the freeing mechanism 620 has been released, the docking station will return to its original capped position via the system return spring (not shown).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A docking station, comprising:

a housing operable to receive and releasably secure a handheld printer;

a freeing mechanism, wherein the freeing mechanism is operable to release the handheld printer from the housing; and a print head cap operable to receive a print head of the handheld printer when the handheld printer is secured in the housing.

2. The docking station of claim 1, further comprising a print head wiper, wherein the print head wiper is operable to wipe the print head of the handheld printer during the release of the handheld printer from the housing.

3. The docking station of claim 1, wherein the print head cap is operable to enclose the print head of the handheld printer when the handheld printer is secured in the housing.

4. The docking station of claim 3, further comprising at least one control rib operable to position the print head of the handheld printer when the handheld printer is secured in the housing.

5. The docking station of claim 1, wherein the print head cap comprises at least one rubber seal.

6. The docking station of claim 1, wherein the freeing mechanism comprises a rotatable lever or wheel.

7. The docking station of claim 1, further comprising at least one docking latch operable to releasably secure a handheld printer to the housing.

8. The docking station of claim 7, wherein the freeing mechanism is operable to move at least one docking latch to release the handheld printer from the housing when the freeing mechanism is operated.

9. A method for releasably capping a print head, comprising:

receiving, in a housing, a handheld printer;

capping a print head of the handheld printer upon its insertion into the housing, wherein capping is performed by a print head cap operable to receive the print head of the handheld printer;

releasing the print head from the print head cap when the handheld printer is released from the housing; and wiping the print head as the handheld printer is released from the housing.

10. The method of claim 9, wherein capping the print head comprises enclosing the print head of the handheld printer when the handheld printer is secured in the housing.

11. The method of claim 9, further comprising positioning the print head of the handheld printer in the housing using at least one control rib operable to position the print head of the handheld printer in the housing.

12. The method of claim 9, wherein the print head cap comprises at least one rubber seal.

13. The method of claim 9, wherein releasing the print head comprises releasing the print head using a rotatable lever or wheel.

14. The method of claim 13, further comprising moving at least one docking latch to release the handheld printer from the housing using the freeing mechanism.

15. The method of claim 9, further comprising releasing the handheld printer from the housing using a freeing mechanism.

16. A method of cleaning a handheld printer, comprising:

receiving a hand held printer in a docking station; and wiping the print head of the hand held printer upon the movement of a freeing mechanism of the docking station during release of the hand held printer from the docking station using a print head wiper within the docking station.

17. The method of claim 16, wherein the movement of the freeing mechanism of the docking station is effected by a user.

* * * * *